United States Patent [19]

Seibert

[11] 4,456,199

[45] Jun. 26, 1984

[54] WINDING MACHINE FOR WINDING STRAND-SHAPED WINDING MATERIAL ON A SPOOL

[76] Inventor: Gerhard Seibert, Putzendoplergasse 3, Vienna A-1232, Austria, A-1232

[21] Appl. No.: 276,288

[22] Filed: Jun. 22, 1981

[30] Foreign Application Priority Data

Jun. 27, 1980 [DE] Fed. Rep. of Germany ..... 3024095

[51] Int. Cl.[3] ..... B65H 54/28

[52] U.S. Cl. ..... 242/158 R; 242/25 R

[58] Field of Search ..... 242/158 R, 158 B, 158 F, 242/158.2, 158.3, 158.4 R, 158.4 A, 25 R, 7.15, 7.16, 45; 226/45, 24, 10

[56] References Cited

U.S. PATENT DOCUMENTS

| | | | |
|---|---|---|---|
| 2,900,145 | 8/1959 | Hanson | 242/158.2 |
| 3,237,875 | 3/1966 | Van Der Hoek et al. | 242/158.4 R |
| 3,319,070 | 5/1967 | Schneider | 242/158 R X |
| 3,544,035 | 12/1970 | Woolever | 242/158 R |
| 3,779,480 | 12/1973 | Cambou | 242/158 R |
| 3,833,184 | 9/1974 | Hara et al. | 242/158 R |
| 3,951,355 | 4/1976 | Morioka et al. | 242/158 R |
| 4,022,391 | 5/1977 | Stein et al. | 242/158 R X |
| 4,086,472 | 4/1978 | Sikora | 242/158 R X |
| 4,195,791 | 4/1980 | Frazee, Jr. | 242/45 |
| 4,244,539 | 1/1981 | Taneda et al. | 242/158 R |

FOREIGN PATENT DOCUMENTS

| | | | |
|---|---|---|---|
| 2153697 | 5/1973 | Fed. Rep. of Germany | 242/158.2 |
| 37-6712 | 7/1962 | Japan | 242/158.2 |
| 37-13766 | 9/1962 | Japan | 242/158.2 |
| 54-8352 | 1/1979 | Japan | 242/158.2 |
| 935084 | 8/1963 | United Kingdom | 242/158 R |

*Primary Examiner*—Stanley N. Gilreath
*Attorney, Agent, or Firm*—Martin A. Farber

[57] ABSTRACT

A control device for obtaining a uniform or even winding is provided for a winding machine for winding strand-shaped winding material, and includes a first measurement device which detects the position of the last winding to have been wound in each instance, a second measuring device for detecting the relative position of a spool with respect to a strand guide, and a computer for controlling the feed drive for the relative reciprocating traversing movement between the spool and the strand guide.

8 Claims, 13 Drawing Figures

Fig.1
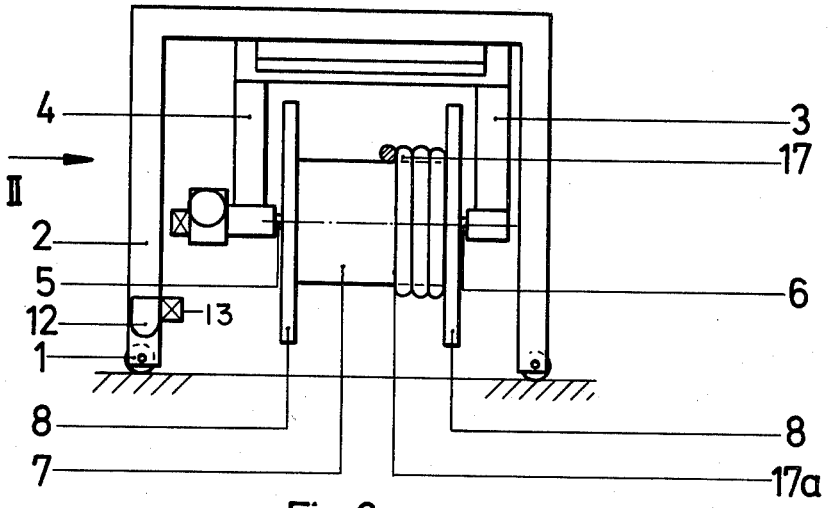
Fig. 2
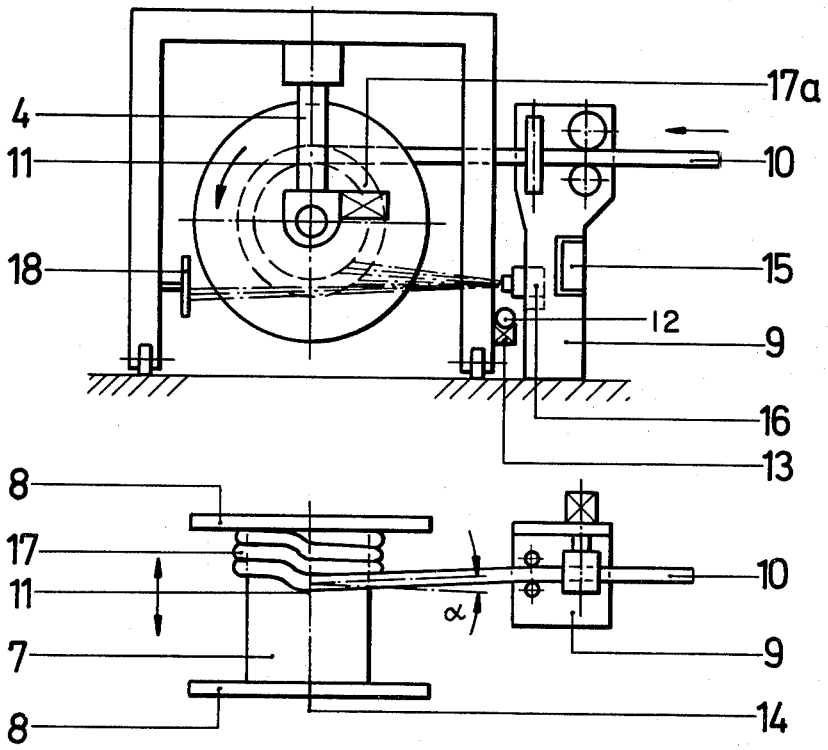
Fig.3

Fig.10
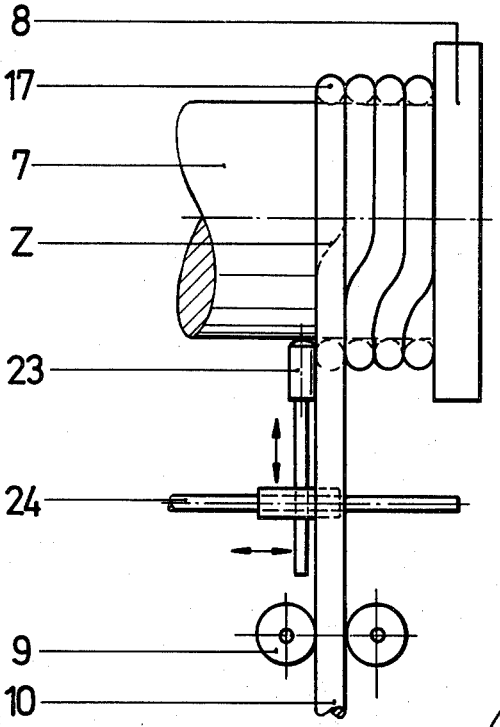
Fig.11
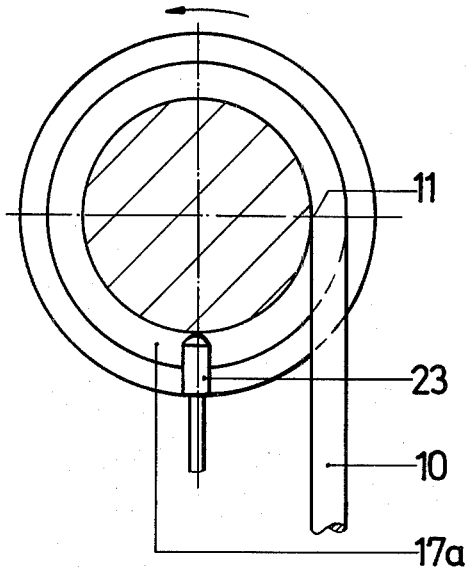
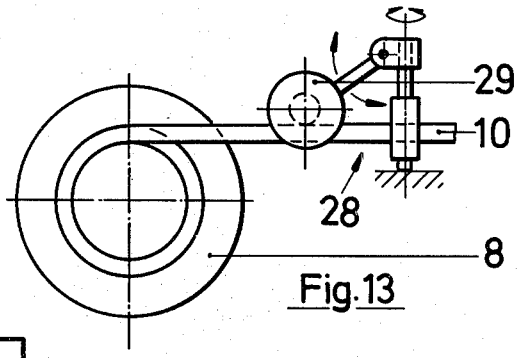
Fig.13
Fig.12
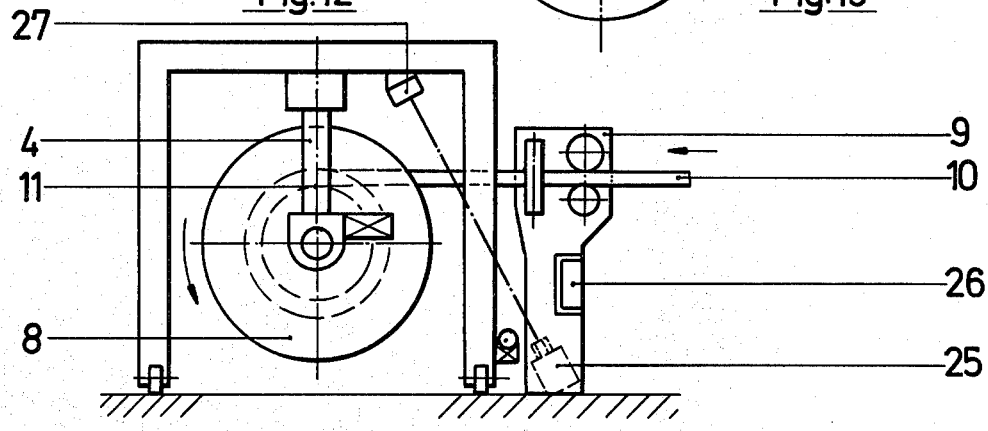

WINDING MACHINE FOR WINDING STRAND-SHAPED WINDING MATERIAL ON A SPOOL

The present invention relates to a winding machine for winding strand-shaped winding material onto a spool to which the winding material is fed via a strand guide (the guide for the material to be wound), the machine having a feed drive for a reciprocating traversing movement of spool and strand guide along each other and having a control device for maintaining a constant run-on angle for the accurate laying of the turns within each winding layer.

Winding machines are known in which the strand guide is developed as a laying fork which is swingable about a vertical axis (West German Pat. No. 15 74 425), the fork being swung to the side by the travel of the run-on point of the winding material on the bobbin, thereby actuating limit switches which actuate a feed drive for an axial displacement of the winder until a relative position of spool and laying fork which corresponds to the desired run-on angle, i.e. in general a "hold-back angle" is again obtained. With such a manner of operation, to be sure, a deviation of the run-on angle from the desired value that is sufficient to actuate the limit switches must be permitted, it being assumed that, even with a large deviation of the run-on angle, turn still rests against turn and no turn rises in undesired manner into the next winding layer. This prerequisite is, however, not always reliably satisfied, since the laying or displacement feed is not constant inasmuch as with accurate laying, the first turn on the flange always extends parallel to the flange. As a result the other turns are also not wound on the spool in the manner of a continuous helix but rather orthocyclically, i.e. after 360° in each case a lateral offset is present in the turn, which otherwise extends parallel to the main flanges. The laying movement must therefore be adapted to this offset of each turn. However, particularly when the desired run-on angle or the hold-back angle has become somewhat too great or if the winding material tends to stick or has a non-slide rubber-like surface, a turn may rise into the next higher winding layer at such an offset point. Such defeat can, however, not be corrected automatically with the known winding machines which operate with a swingable laying fork, but must be corrected by the intervention of the operator.

The object of the invention is to eliminate variations in the run-on angle during the development of the corresponding winding layer in a winding machine of the above-indicated type in which the distance or application pressure between adjacent turns of a winding layer is determined exclusively by the relative movement between the spool and strand guide In order to achieve this objective, according to the invention the control device comprises a first measuring device which determines the position of the winding last wound in each case at a measurement point which is located at a given angle of rotation of the spool in front of the winding material run-on point, a second measuring device for detecting the instantaneous traversing position of the spool and strand guide and of a computer which, on the basis of the measurement data of the two measurement devices, calculates that relative position which the spool and the strand guide must have reached after the rotation of the spool by the aforesaid bobbin angle of rotation in order to maintain the run-on angle and orders it from the feed drive. In the invention therefore the position of the subsequent run-on point is continuously first determined and the relative movement between spool and strand guide is so controlled during the intervening time that when the previously determined run-on point reaches the actual winding-material run-on point the desired run-on angle is always maintained. If therefore, for instance, 60° before in the turn last laid is noted, for instance, 60° before the actual run-on point, the traversing drive will be actuated in such a manner that after effecting the 60° rotation of the spool, the relative position of the bobbin and strand guide is again the same as it was at the earlier measurement time. Since, with this method of operation, the run-on point is always detected as a function of the turn which has last been wound, no cumulative errors occur in the calculation of the traversing movements. As has been shown by practical tests, this type of early control of the traversing drive results in high reliability and accuracy in laying and represents a substantial step forward in the general endeavors to create completely automatic winding machines which no longer require monitoring or correction by an operator.

In accordance with the invention, the first measuring device may comprise of a laterally movable feeler member which laterally feels the turn last wound and, as a function of its deflection, supplies a measurement value of the position of the turn relative to the strand guide.

Instead of such a mechanical feeling there is preferred in the invention, however, a contact-less nonmechanical detection of the last turn wound. For this, the first measurement device can, for instance, comprise an opto-electrical television camera which is directed tangentially to the uppermost winding and monitors the travel of the front end of the layer just wound. The output signal of this television camera is evaluated in the manner that the position of the front side of the winding layer with respect to a fixed coordinate parallel to the axis of the spool is indicated. At the same time, the instantaneous position of the spool on this fixed coordinate is also noted if the spool effects the traversing movement, or else the instantaneous position of the strand guide if the latter effects the traversing movement. From the two measurement data, together with the known diameter of the winding material, it is then possible to calculate the relative position which spool and strand guide must have when the measured position of the last turn has reached the run-on point of the winding material. The measuring of the last turn of a layer can be effected, for instance, ten times per revolution of the spool; accordingly, for each revolution of the spool there are ten desired positions of the winder (or strand guide) which are to be reached by the traversing drive after the corresponding portion of a revolution of the spool, i.e. depending on how far the measurement point is from the run-on point.

When calculating the respective corresponding desired position, a hold-back angle which is to be set individually at each time can, of course, also be taken into account. The optimum hold-back angle, which is dependent on the winding material, can be set by programming the computer.

With the manner of operation in accordance with the invention, therefore, the last turn is used in each case as a form for the next turn. The separation in time between the measurement point and the run-on point furthermore provides the great advantage that the traverse movements, which are subject to inertia, can be started at the proper moment and via the computer even as a function of speed so that unintended climbing up of the winding material can definitely be avoided.

In accordance with an alternative embodiment, the first measurement device may comprise remote sensors, for instance ultrasonic sensors, directed radially to the spool. In accordance with another alternative, the first measuring device may also comprise a video camera which is directed radially to the spool and a light projector, inclined to the camera, which strikes the spool with a band of light which extends over the run-on region of the winding material.

In accordance with the invention, the first measuring device may also comprise a video camera which is directed on the arriving strand of winding material at a distance in front of the run-on point and detects the run-on angle, or of a sensor device which detects the run-on angle of the winding material, the computer calculating from these measured values the actual position of the run-on point and thus the desired position of the run-on point after a further rotation. In this embodiment also, the position of the last turn is measured indirectly at a place which is located in advance—in this case in advance by a 360° spool rotation—and from this the traversing position which the spool and the strand guide must have reached after another full revolution of the spool is calculated and ordered.

For the detection of the instantaneous traversing position of spool and strand guide there is used the second measuring device which in accordance with the invention, may comprise a pulse tachometer which travels along with the laying drive and, so to speak, scales the path of the laying drive.

In the case of a flexible winding material which may be deflected laterally around guide rollers upon the winding, the traversing movement can be effected in known manner by an axial traverse of the strand guide along the stationary spool. With other winding material, for instance thicker electric cables, it is on the other hand necessary for the strand guide to remain stationary and for the spool to effect the traversing movement. The invention can be employed in the same manner with both types. In addition to this the feed drive means can, in accordance with the invention, effect the traversing movement of the spool with a fixed pre-established speed and the strand guide can be displaceable also in the traversing direction but effecting only the movements of correction determined by the control device in accordance with the invention. For example the strand guide is provided with an additional drive means for carrying out correction movements as a function of output commands of said computer means. Such an embodiment is particularly advantageous when winding is to be effected at very high speeds.

The invention will be explained in further detail below with reference to a winding machine in which the drum is moved back and forth along the strand guide in accordance with the self-laying method. In the drawing:

FIG. 1 is a front view of a winding machine in accordance with the invention;

FIG. 2 shows the winding machine of FIG. 1, in side view seen in the direction of the arrow II;

FIG. 3 is a partial top view of the winding machine of FIG. 2;

FIGS. 10 and 11 show a fourth embodiment for detecting the turn which has last been wound; and FIGS. 12 and 13 show a fifth and sixth embodiment in which the position of the turn last wound is determined indirectly.

Figure 4:
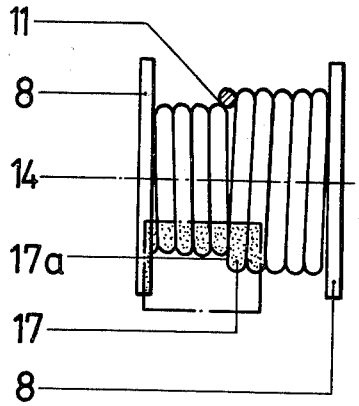
FIGS. 4 and 5 show a first embodiment of a measuring device for detecting the position of the turn which has been last wound.

FIGS. 1 to 3 show a winding machine having a four-leg frame 2 which is movable on rollers 1 and from the upper part of which there are suspended two spindle sleeve arms 3, 4, a spool 7 having flanges 8 being received on lower spindle sleeves 5, 6. By means of a strand guide 9 which is arranged in fixed position, the spool 7 is fed a strand-shaped winding material 10 which is to be wound with closely adjacent turns and with winding layers arranged precisely above one another. During the winding process, the winding material run-on point 11 travels back and forth between the spool flanges 8; in order to obtain a close application of adjacent turns, the winding material should travel onto the spool with a constant run-on angle $\alpha$. In order to maintain the angle $\alpha$, the winder in the embodiment shown by way of example is moved back and forth on bottom rails in front of the strand guide 9 by means of a feed drive 12 which imparts rotation to the rollers 1. A measuring device 13 developed as a pulse tachometer is operatively responsive to the feed drive 12 and thus to movement of the frame 2 on the rotating rollers for determining the positioning of the winding machine or of the spool 7 relative to a fixed coordinate parallel to the spool axis 14 and delivering it to a computer 15 which is arranged on the strand guide 9 in the embodiment shown by way of example.

The computer 15 furthermore contains, received from another measuring device 16, values for the instantaneous position of the last-wound turn 17, this measurement being effected at a point which precedes the actual winding-material run-on point by a given angle of rotation, in this case 180°.

Figure 5:
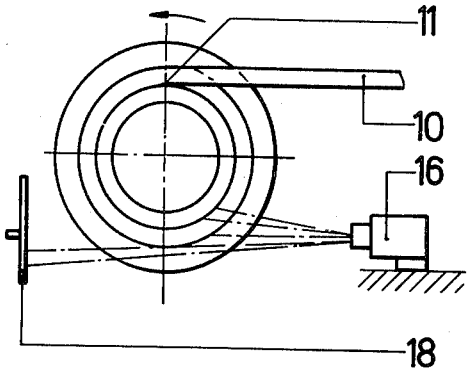

The measurement device 16 of FIGS. 1 to 5 is a television camera which is directed tangentially to the spool winding and is arranged opposite an optical contrast surface 18 on the other side. The measurement device 16 is preferably actuated cyclically and supplies, for instance ten or twenty times per revolution of the spool, a signal for the position of the winding flank 17*a* of the last turn wound 17 at the position 180° from the actual run-on point 11. From the measurement data supplied by the two measurement devices 13 and 16, the computer 15 calculates in each case the relative position which must exist between the spool 7 and the strand guide 9 after an additional 180° rotation of the spool in order for the desired run-on angle $\alpha$ to be maintained. The control of the traversing movement can be effected very precisely here so that the traversing movement can closely follow the irregular course of the individual turns shown on a larger scale in FIG. 10. The danger of the winding material unintentionally climbing at such a winding offset Z into the next higher winding layer is excluded with the manner of control employed in the invention. In FIG. 5, as well as in FIGS. 7, 9 and 13 which will be described further below, the left hand spool flange 8 has been omitted in each case.

Figure 6:
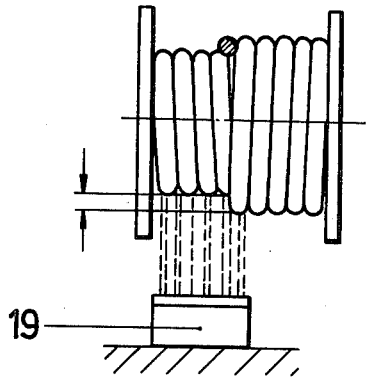
FIGS. 6 and 7 show a second embodiment of a device for detecting the turn which has been last wound.
Figure 7:
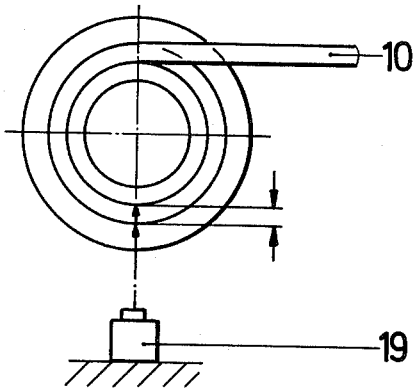

FIGS. 6 and 7 show an embodiment in which the device for detecting the position of the last wound turn comprises remote sensors 19 directed radially toward the spool, for example possibly ultrasonic sensors.

Figure 8:
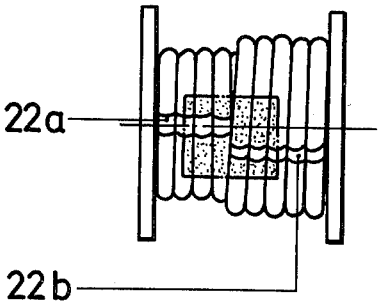
FIGS. 8 and 9 show a third embodiment for detecting the turn which has been last wound.
Figure 9:
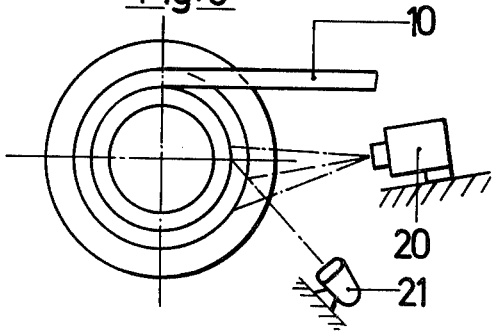

As a further alternative, FIGS. 8 and 9 show a measurement device which comprises a television or video camera 20 directed approximately radially to the spool and a light projector 21 inclined with respect to the camera, and illuminating the spool 7 over its entire length with a band of light 22*a*, 22*b*. As a result of the difference in alignment of the projector 21 and the camera 20, the band of light shifts for the camera at the boundary between two winding layers arranged one above the other and accordingly therefore the building up and travel of the front surface of the upper windng layer can be precisely followed by the camera 20.

FIGS. 10 and 11 show a mechanical sensing member 23 which rests on the side surface of the last turn wound 17*a* at a point which is about 90° in front of the run-on point 11 of the winding material. The sensing member 23 is displaceable on a guide 24 which is parallel to the axis of the spool. Upon travel, for instance, onto the incline of the offset Z of a turn, the sensing member 23 is temporarily displaced in the direction of the guide 24, this movement, however, being measured and utilized to calculate and trigger a drive command for the traversing drive so that the spool, after a 90° rotation, is again in the same relative position with respect to the strand guide and therefore the sensor member 23 could return into the basic position shown.

In the embodiment shown in FIG. 12, the position of the last turn wound is measured indirectly from the inclination or run-on angle of the approaching strand 10 of winding material by means of a television camera 25 and delivered to the computer 26. The television camera is directly obliquely upwards and opposite it there is a contrasting field 27 or luminous band for the easier detection of the winding strand. When the offset Z of a turn arrives at the run-on point 11 of the winding material, the run-on angle changes by a given amount. The computer stores this information and controls the traversing drive in such a manner that the traversing position is displaced by an amount equal to the diameter of the winding material after a further revolution of the spool.

In the embodiment shown in FIG. 13, the run-on angle is continuously detected by a mechanical scanning device 28 with feeler roller 29. The evaluation is effected in this case in the same way as in the preceding embodiment shown in FIG. 12.

I claim:

1. In a winding machine for winding strand-shaped winding material on a spool to which the winding material is fed via a strand guide, having a feed drive for a reciprocating relative traversing movment of the spool and the strand guide along each other and having a control device for maintaining a constant run-on angle of the winding material running onto the spool for accurately laying turns of the winding material within each winding layer, the control device including a first and a second measurement means for detecting, respectively, locating of the winding material and instantaneous traversing position of said spool relative to said strand guide, the improvement wherein said first measurement means detects a position of a last-wound turn at a measurement point which is at a predetermined angle of rotation of the spool in front of a run-on point of the winding material onto the spool, and said control device further comprises computer means for receiving measurement values from said first and second measurement means and for calculating a relative position which said spool and said strand guide must reach after rotation of said spool by said predetermined angle of rotation of the spool in order to maintain said run-on angle and for commanding said relative position from the feed drive.

2. The winding machine according to claim 1, wherein said first measurement means comprises a laterally movable sensing means for laterally contacting said last-wound turn, and, as a function of deflection of said sensing means, for supplying the measurement value, therefrom to said computer means, for the position of said last-wound turn.

3. The winding machine according to claim 1, wherein the winding layer that includes the last wound turn is an uppermost winding layer, and said first measurement means comprises an opto-electrical video camera which is directed tangentially to said uppermost winding layer.

4. The winding machine according to claim 1, wherein said first measurement means comprises remote sensors which are spaced from and directed radially toward said spool.

5. The winding machine according to claim 4, wherein said remote sensors are ultrasonic sensors.

6. The winding machine according to claim 1, wherein said first measurement means comprises a television camera which is directed radially toward said spool and a light projector arranged opposite to said camera directed so as to illuminate said spool with a band of light which extends over a run-on area of the winding material.

7. The winding machine according to claim 1, wherein the feed drive is arranged to move the spool, and said second measurement means comprises a pulse tachometer mounted so as to travel along with the spool.

8. In a winding machine for winding strand-shaped winding material on a spool to which the winding material is fed via a strand guide, having a feed drive for a reciprocating relative traversing movement of the spool and the strand guide along each other and having a control device for maintaining a constant run-on angle of a running-on strand of the winding material running onto the spool for accurately laying turns of the winding material within each winding layer, the control device including a first and a second measurement means for detecting, respectively, location of the winding material and instantaneous traversing position of said spool relative to said strand guide, the improvement wherein said first measurement means is spaced at a distance in front of a run-on point of the winding material onto the spool for detecting the run-on angle of the running-on strand, said control device further comprising computer means for receiving measurement values from said first and second measurement means and for calculating an actual position of the run-on point and a desired position of the run-on point after a further rotation of the spool from the measurement values of said first measurement means, and wherein said first measurement means is a television camera which is directed tangentially to the uppermost winding and monitors the travel of the front end of the layer being wound.

* * * * *